United States Patent [19]

Fuchs

[11] Patent Number: 4,946,069

[45] Date of Patent: Aug. 7, 1990

[54] DISPENSER FOR MANUALLY DISCHARGING FLOWABLE MEDIA

[75] Inventor: Karl-Heinz Fuchs, Radolfzell, Fed. Rep. of Germany

[73] Assignee: Ing. Erich Pfeiffer GmbH & Co. KG, Fed. Rep. of Germany

[21] Appl. No.: 254,965

[22] Filed: Oct. 5, 1988

[30] Foreign Application Priority Data

Oct. 10, 1987 [DE] Fed. Rep. of Germany ..... 3734306

[51] Int. Cl.[5] ..... B65D 88/54

[52] U.S. Cl. ..... 222/43; 222/153; 222/321; 604/210; 604/220

[58] Field of Search ..... 222/43, 319–321, 222/383, 385, 402.1, 153, 41, 44, 47, 49, 50; 604/208–210, 214, 218, 220

[56] References Cited

U.S. PATENT DOCUMENTS

| | | | |
|---|---|---|---|
| 1,670,570 | 5/1928 | Hein . | |
| 1,926,367 | 9/1933 | Booth | 221/78 |
| 2,474,496 | 6/1949 | Rayman | 604/210 |
| 2,578,812 | 12/1951 | Kollsman | 604/210 |
| 2,856,925 | 10/1958 | Hellmer et al. | 604/210 |
| 3,923,059 | 12/1975 | Ogle | 128/237 |
| 3,934,586 | 1/1976 | Easton et al. | 604/208 |
| 4,072,249 | 2/1978 | Ekenstam et al. | 604/214 |
| 4,175,704 | 11/1979 | Cohen | 222/321 |
| 4,308,977 | 1/1982 | Sigmund et al. | 222/320 |
| 4,726,747 | 2/1988 | Skorka | 222/383 |
| 4,758,232 | 7/1988 | Chak | 604/220 |
| 4,820,272 | 4/1989 | Palmer | 604/218 |

FOREIGN PATENT DOCUMENTS

| | | | |
|---|---|---|---|
| 0021123 | 7/1983 | European Pat. Off. . | |
| 0218840 | 4/1987 | European Pat. Off. . | |
| 3315334 | 10/1984 | Fed. Rep. of Germany | 222/321 |
| 805024 | 11/1936 | France . | |
| 949453 | 8/1949 | France . | |
| 1577954 | 8/1969 | France | 604/210 |

*Primary Examiner*—H. Grant Skaggs
*Assistant Examiner*—Steven M. Reiss
*Attorney, Agent, or Firm*—Steele, Gould & Fried

[57] ABSTRACT

In a discharging apparatus (1) for in particular a single use, the complete pump stroke (11) to be performed only once is subdivided into at least two partial strokes (12,13) by a limiting device (24) which, for the end of each partial stroke, has a stop (25) to be overcome in the manner of a resilient detent. All parts of the limiting device (24) are located in such a way that the guidance of pump piston (6) on thrust piston pump (4) on the piston running path (7) is in no way impaired. At the end of the last partial stroke (13) the pump cylinder (5) mountable as a separate vessel on pump piston (6) is positively locked with respect to the remaining discharging apparatus (1) by a removal preventing means (40), so that the interior of pump cylinder (5) is no longer accessible.

26 Claims, 1 Drawing Sheet

DISPENSER FOR MANUALLY DISCHARGING FLOWABLE MEDIA

BACKGROUND OF THE INVENTION

1. Field of the Invention

The invention relates to a discharging apparatus for flowable or fluid media with a body for receiving a media reservoir and with a thrust piston pump, which has a pump piston displaceably guided on the piston running path of a pump cylinder between a starting position and a pump stroke end position and with a pump chamber defined by the pump cylinder and the pump piston and connected to a discharge opening of the apparatus via an outlet channel in the form of a dosing chamber determining the discharge volume per pump stroke.

2. Prior Art

Such discharging apparatuses are generally used for the dosed discharge of the flowable medium in dosing volume units, so that they are particularly suitable for Pharmaceutical, cosmetic and similar products The thrust piston pump of the discharging apparatus can be arranged on a storage container from which it draws off during the return stroke in the upright normal position and/or in the reverse inverted position into the pump chamber, optionally via an intake valve closing during the pump stroke. However, the discharging apparatus can also be constructed as a one-way applicator, whose stored media supply is exhausted after a complete pump stroke, so that there is no repeated filling of the pump chamber. Certain media require a very precise dosing in individual doses tailormade to the user, but it would be very difficult and costly to construct the dosing chamber in different sizes in accordance with the particular use.

SUMMARY OF THE INVENTION

An object of the present invention is to provide a discharging apparatus of the aforementioned type enabling in simple manner the discharge of a dosed quantity of the flowable medium and which is smaller than the effective working volume of the dosing chamber or compared with a dosage quantity discharged during a complete pump stroke.

According to the invention this object is achieved in the case of a discharging apparatus of the aforementioned type in that there is a limiting device at the most extending up to the piston running path for reducing the discharge volume to at least one partial volume. The limiting device effectively ensures that a media quantity corresponding to the complete pump stroke Is not discharged. The partial quantity discharged also constitutes an accurately dosed quantity or quantity precisely determined by the limiting device and does not merely represent a random partial quantity, as would be the case with a conventional thrust piston pump by not forcing the pump piston completely into its pump stroke end position. As the limiting device does not project inwards over the piston running path or outwards with respect to the envelope surface of said path and is also not axially displaced with respect to said path, this cannot lead to damage to the piston guide or to the sealed engagement of the pump piston on the piston running path.

The limiting device could e.g. be an opening in the pump cylinder to be made by a tool or which already exists and which is closed on the pump stroke part corresponding to the partial volume and is then opened in such a way that the pressure in the pump chamber drops and consequently no further discharge takes place. However, a particularly advantageous embodiment is obtained if the limiting device has at least one stop associated with a counter-stop and in particular a stroke stop limiting the pump stroke to at least one partial stroke, said stop or counter-stop appropriately extending at the most up to the piston running path or being located substantially outside the latter and in particular on an outer side of the pump cylinders. The piston running path defines an elongation envelope along the surface of sliding engagement of the piston and cylinder, and any extension of this surface.

According to the particular requirements, the limiting device could be constructed in such a way that the associated partial volume cannot be changed after the limiting device has been fixed. However, in order to offer the possibility of discharging a further, identical or different partial volume following the discharge of a first partial volume, the limiting device is appropriately detachably constructed in the sense of removing the limitation. This can be very simply achieved in that the stop is constructed as a detent which can be overcome under a predetermined pump operating force. Thus, the limiting device acts on the basis of a tangible resistance higher than the normal pump operating force and directed opposite to the latter and which can be overcome by increasing the operating force by the user directly following onto the preceding partial stroke, so that it is also possible to discharge two or more partial volumes immediately following one another.

The stop or counter-stop can be provided on components of the discharging apparatus, which are not directly formed by the pump cylinder or pump piston, or are arranged separately therefrom or are spaced therefrom. In order to obtain compact dimensions and a particularly precise stop function, the stop is appropriately provided on a component movable with respect to the pump cylinder and in particular with the pump piston. Preferably the counter-stop is formed by the pump cylinder, so that no separate components are required and the counter-stop can even be formed without separate shaping by an outside of the pump cylinder.

In order to achieve a relatively gentle stop limitation at the end of the partial stroke and also for simply overcoming the detent, according to a further inventive proposal the stop is resiliently constructed and is in particular provided on a spring arm roughly parallel to the pump axis. The stop preferably has a ramp for the counter-stop, so that on correspondingly increasing the operating force exerted on the thrust piston pump the stop can be directly moved by the pressure of the counter-stop or the counter-stop surface out of the stop position in a resilient manner.

The stop could also be located within the pump cylinder, but spaced from the piston running path, e.g. in that it projects over the inner end of the pump piston and runs up onto a base surface of the pump cylinder as a counter-stop and then the stop would be lockingly movable by the partial strokes with respect to the pump piston. However, it is particularly advantageous for the stop to be located outside the pump cylinder and in particular to be associated with an end face of the pump cylinder serving as a counter-stop. Preferably the stop is located in freely projecting manner in an in particular cap-like operating handle for the thrust piston pump so that, despite being arranged outside the cylinder, it is protected. If the stop extends in flange-like manner around the pump axis and if it is e.g. formed by at least one inner collar, which is preferably circumferentially subdivided, in the case of small dimensions this leads on the one hand to a very high strength and on the other the stop can be used for the additional reciprocal guidance of the pump piston and pump cylinder over at least one partial stroke. This construction also leads to relatively high spring tensions of the stop.

According to a further development of the invention the stop is constructed in the manner of a resiliently spreadable clip, which is in particular formed by at least two partial sleeve-like spring arms, which permits a very precise reciprocal alignment of the stop and the pump cylinder.

It is particularly advantageous if the stop is formed by a component separate from the pump piston and fixed in a mounting support, because then for obtaining different partial volumes it is possible to fit different stops to the same discharging apparatus. For example the stop can be formed by a muff-like stop member, which in particular has one end wall and spring arms projecting therefrom, the stop member preferably being fixed by springing into a holding clip passing round the outer circumference thereof.

The reciprocal alignment of the pump cylinder and the pump piston, at least in the vicinity of the particular stop position can be significantly improved in that a centering guide is provided upstream of the stop face and is preferably formed by at least one conical inner face of the stop body, on which the pump cylinder appropriately runs with a circumferential edge which is acute-angled in cross-section.

In the case of the described construction as a one-way applicator the media reservoir is appropriately directly formed by the pump cylinder, which is in this case constructed in cup-shaped manner and can be closed on the bottom by a bottom wall constructed in one part with its casing or jacket. Advantageously said pump cylinder is constructed as a vessel separate from the remaining discharging apparatus and which is closed at its open end by a suitable closure, e.g. with a tear-open closure constructed in the manner of a crimped closure. Following the opening of the closure the vessel filled with the medium can be mounted on the pump piston. The medium to be discharged is consequently transported, stored and kept ready for use in a vessel forming the pump chamber and is then directly discharged out of said vessel with the discharging apparatus via the outlet channel and through the discharge opening. The construction can be such that after pumping the pump piston empty the vessel is removed and replaced by a new, full vessel.

To further simplify the construction of the inventive discharging apparatus the body is formed by the operating handle, which preferably receives in a discharge connection projecting over an end wall a piston shaft forming the pump piston located within the handle and the stop on the inside of the end wall carrying the discharge connection, so that apart from the vessel only three separate components are required for the discharging apparatus. If the stop is constructed in one piece with the body, then only two such components are required.

In particular for a discharging apparatus of the described type, but also for a differently constructed discharging apparatus, it is proposed to provide a return stroke or removal preventing means for the pump piston or pump cylinder in such a way that at least after performing a specific partial stroke the reciprocal return of the pump piston and cylinder to the starting position is blocked and consequently a repeated, complete pump stroke cannot be carried out. This is particularly advantageous where it is vital to ensure that it is not possible to discharge an excessive medium quantity and to prevent accessibility of the media residues contained in the vessel as a result of drawing the pump piston out of the pump cylinder or the vessel. The removal preventing means, e.g. constructed in the manner of a freewheel and which although allowing the continuation of the pump stroke it blocks any return stroke movements, can be formed very simply and directly by the stop, which preferably engages in barb-like manner behind a ring shoulder of the pump cylinder when the pump piston has moved in the direction of the pump stroke and accompanied by the overcoming of the detent has passed beyond the associated stop position.

The inventive construction is in particular suitable for discharging apparatus, in which the discharge opening is constructed as a spraying nozzle. For example in the case of a nose spray there can be two limited partial volumes or two stop-limited partial strokes, each partial volume being intended for use in one of the two nostrils of the user and only the first stop position can be overcome or cleared.

These and further features of preferred further developments of the invention can be gathered from the drawings, description and claims, whereby the individual features can be realized singly or in the form of subcombinations in an embodiment of the invention and in other fields and represent advantageous, protectable constructions for which protection is claimed here.

BRIEF DESCRIPTION OF THE DRAWINGS

Embodiments of the invention are described hereinafter relative to the drawings, wherein are shown.

DETAILED DESCRIPTION OF THE PREFERRED EMBODIMENTS

Figures 1, 2, 3, 4, 5:
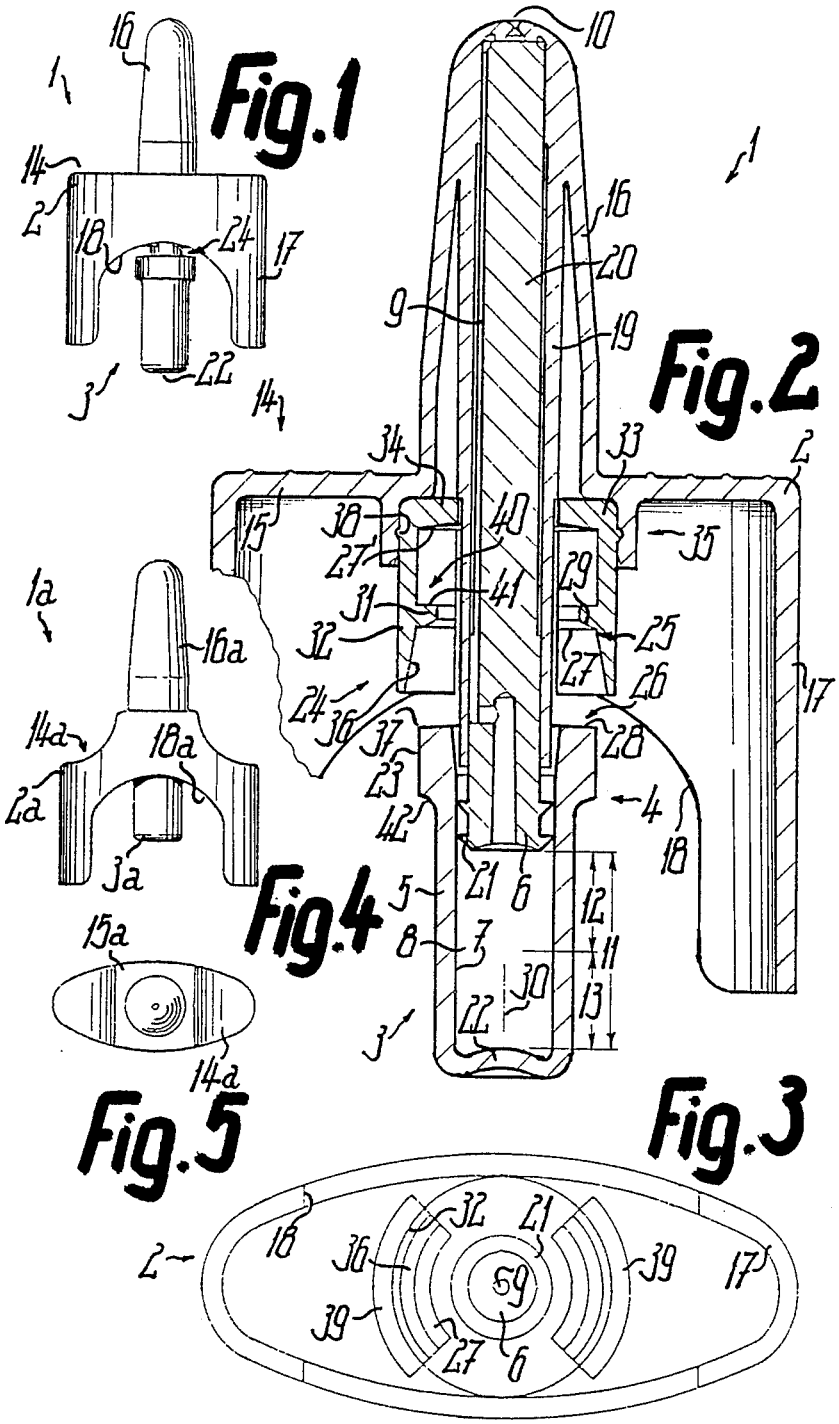
FIG. 1: an inventive discharging apparatus in elevation and approximately natural size.
FIG. 2: the discharging apparatus according to FIG. 1 in axial section.
FIG. 3: the discharging apparatus of FIG. 2 in a view from below, but with the pump cylinder removed.
FIG. 4: another embodiment in a view corresponding to FIG. 1.
FIG. 5: the discharging apparatus of FIG. 4 in plan view.

The discharging apparatus shown in FIGS. 1 to 3 is constructed for the discharge of relatively small media quantities of under 1 ml and can e.g. have a length of only roughly 5 cm. The discharging apparatus 1 is made solely from plastic parts, which are appropriately produced by injection moulding and are connected by plugging together.

The discharging apparatus 1 has a body 2 constructed in the manner of a casing and which carries a media reservoir 3 movable with respect thereto and a thrust piston pump 4. The latter has a pump cylinder 5 directly formed by the media reservoir 3 and which is substantially located within the body 2 and is formed by a vessel cylindrical over most of its length. The body 2 carries a pump piston 6 fixed thereto and with which is associated as the piston running path 7 the inner face of the pump cylinder 5. Pump piston 6 defines at one end of the pump cylinder 5 a pump chamber 8, which simultaneously constitutes the storage space of the media reservoir 3. From the inner end face of pump piston 6 emanates an outlet channel 9, which is guided in valve-free manner to a discharge opening 10 leading into the open and which is formed by an atomizing nozzle.

With respect to the pump cylinder 5, pump piston 6 is only movable over a single complete pump stroke 11 through which the pump cylinder 5 or media reservoir 3 is substantially completely emptied and which is subdivided by a limiting device, which is yet to be described, into two roughly equally long partial strokes 12,13.

For performing the pump stroke body 2 forms an operating handle 14, which is essentially formed by the outer end face of an oval end wall 15. Over the outside of the center of end wall 15 projects a discharge connection 16 located in the axis of the thrust piston pump 4 and which is constructed in one piece with the body 2 and has in its end face the discharge opening 10. Oppositely directed with respect to the discharge connection 16, an oval cap casing 17 in a view of end wall 15 projects from the edge of the latter and its axial extension is approximately the same as that of the discharge connection 16, but is preferably slightly larger than the latter.

In the starting position according to FIGS. 1 and 2 the pump cylinder 5 or the media reservoir 3 with a part of its length projects over beyond the open end of the cap casing 17 while, after performing the pump stroke 11 or the first partial stroke 12, it is completely located within the cap casing 17. On the flattened sides, pump cap casing 17 is provided with two facing finger openings 18, which are intended to receive the thumb of a user's hand, who applies the index and middle finger of this hand on either side of the discharge connection 16 on the outside of the end wall 15 or on the operating handle 14 formed by it. By moving together the thumb and the two other fingers the pump cylinder 5 is displaced with respect to the pump piston 6 or the body 2 and medium is sprayed out of the pump chamber 8 through the discharge channel 9 and through the discharge opening 10.

The substantially hollow or tubular discharge connection 16 has a piston sleeve 19 constructed in one piece therewith and radially spaced within it, which projects beyond end wall 15 both outwards and inwards into the cap casing 17 and which carries the piston 6 inserted in it. For this purpose the rear end of the piston 6 is extended to a piston shaft 20 constructed in one piece therewith and having roughly the same external cross-sections and which is only set back with respect to the end face of the discharge connection 16 by the discharge nozzle length and with its associated end face engages on an inner shoulder of discharge connection 16 in such a way that a twisting device for the medium is formed between said end face and connection 16. In the vicinity of the pump piston 6, which only projects slightly beyond the piston sleeve 19, the outlet channel is formed by a central longitudinal bore which, immediately behind the end of the piston sleeve 19 located at pump piston 6, passes via a transverse bore into a main portion of the outlet channel 9, which is defined between the outer circumference of piston shaft 20 and the inner circumference of piston sleeve 19 and which can e.g. be formed by at least one longitudinal groove on the outer circumference of piston shaft 20.

The pump piston 6 has at least one and in particular two, successively arranged, annular piston lips 21 constructed in one piece therewith and whereof the front one is provided immediately following onto the front end face of the pump piston 6, while the rear one has a smaller distance from the associated end of piston sleeve 19. Pump cylinder 5 or media reservoir 3 is closed at its end facing the pump piston 6 by a cylinder base plate 22, which is constructed in one piece with the remaining pump cylinder 5 and in roughly spherical segmental manner is curved inwards in such a way that it forms on its outside a thumb depression for the engagement of the thumb cap of the user's hand and on the inside has a correspondingly curved protuberance. The front end face of the pump piston 6 is provided with a depression adapted in substantially identically shaped manner to said protuberance and whose base face strikes against the cylinder base plate 22 at the end of the complete pump stroke 11, so that virtually no residual quantity of the medium to be discharged remains in pump cylinder 5. At the end of this pump stroke the open end of the pump cylinder 5 remote from the cylinder base plate 22 is approximately level with end wall 15.

At this end the pump cylinder 5 has a substantially cylindrical collar 23 constructed in one piece therewith and projecting over its outer circumference and this can serve as a fixing flange for receiving a tear-open closure for media reservoir 3. The external diameter of the piston sleeve 19, at least in its end region engaging in the pump cylinder 5, is roughly as large as the internal diameter of the piston running path 7 or the external diameter of the piston lips 21 or is only slightly smaller than the latter. This freely projecting end of the piston sleeve 19 virtually in all functional positions of the thrust piston pump 4 engages in pump cylinder 5. As a result, even in the case of a relatively thin-walled construction with a wall thickness of e.g. only about 1 mm, the pump cylinder 5 can still be reliably guided and can be simultaneously stiffened by the piston rod formed by the piston sleeve 19 and the piston shaft 20.

In order to subdivide the maximum pump stroke 11 into two or more successively following partial strokes 12,13 a limiting device 24 is provided for which only a single additional component is required in addition to the hitherto mentioned components of the discharging apparatus 1, so that by omitting this component said discharging apparatus can also be used for an undivided pump stroke.

This component has a plurality of successive stops in the stroke direction and which can be one stop larger or smaller than the number of partial strokes, so that at least there is such a stop 25 for all the partial strokes before the last partial stroke. A counter-stop 26 directly formed by the pump cylinder 5 is associated with stop 25 or the successively located stops. Stop 25 has two facing stop faces 27 on either side of the pump axis 30, constructed in the manner of inner shoulders and curved about said axis 30 and with which is associated as a counter-stop face 28 the open end face of the pump cylinder 5 or the collar 23 and namely in its radial outer area. The stop face 27 and/or the counter-stop face 28 has a ramp 29 extending over at least part of its width and the complete stop face 27 can be constructed as a ramp.

Stop 25 is formed by a circumferentially divided, radially inwardly projecting collar 31, whose ring portions are in each case provided on a spring arm 32 freely projecting roughly parallel to the PumP axis 30 in the direction of the pump stroke of pump piston 6 or constructed in one piece therewith. In the represented embodiment there are two facing portions of collar 31 or spring arms 32 in the direction of the longer extension of end wall 15 and which in the view according to FIG. 3 are ring-segmental and whose ends are slightly set back with respect to the shallow curved longitudinal sides of the cap casing 17 and are consequently contact-free with respect to body 2. Spring arms 32 are also curved by an arc angle of approximately 90° about the pump axis 30, so that they form shell-shaped resilient, stable spring elements, which are relatively hard even in the case of relatively small wall thicknesses. Stop 25 or spring arms 32 form a component of a one-piece, muff-like stop body 33, which at its end remote from the free ends of the spring arms 32 has a ring disk-like end wall 34 spaced from stop 25 and which in the vicinity of the connection of discharge connection 16 to its outside engages on a ring shoulder of body 2 formed by the inside of end wall 15. Stop body 33 is fixed by springing into a retaining clip 35, which is constructed in one piece with body 2 and is preferably formed by two ring segmental clip jaws 39, which project from the inside of end wall 15. These clip jaws 39, which only engage around stop body 33 in the vicinity of spring arms 32 and also only over a small part of its length on the outside, are provided on their insides with in each case one ring groove or the like for the engagement of a locking bead 38, which is provided roughly in the plane of the inside of end wall 34 on the outer circumference of stop body 33 and serves for the resilient, axially secured springing of the stop body 33 into the retaining clip 35.

Stop 25 is spaced from the free ends of the spring arms 32 or, in the case of two partial strokes 12,13, roughly in the center of their length. Between the stop face 27 and the free ends directed against the pump cylinder 5 in the starting position, the spring arms 32 form on their facing inner faces centering guides 36 for pump cylinder 5, said centering guides 36 being formed by an inner cone tapering in acute angled manner towards the stop face 27 and with which is associated as a counter-face the outer circumferential edge 37 of the open end of the pump cylinder 5 or the collar 23. In the starting position pump cylinder 5 is located completely outside the stop body 33 or the centering guide 36. As soon as in the described manner the first partial stroke 12 is performed, the open end of pump cylinder 5 is inserted in the centering guide 36, so that apart from being guided and centered by the pump piston 6, pump cylinder 5 is guided and centered directly with respect to stop body 33 or body 2.

At the end of the first partial stroke 12 the counter-stop face 28 strikes against stop face 27, so that a significant or at least noticeable resistance is exerted against further operation of the discharging apparatus 1. If this resistance is overcome by a correspondingly more powerful operation, then as a result of the ramp 29 the spring arms 32 are forced outwards until they slide on the outer circumference of pump cylinder 5 or collar 23 with the inner circumferential surfaces of collar 31 connected to the ramp 29. Thus, on overcoming the stop face 27 the second partial stroke begins. At the end of the last partial stroke 13 the counter-stop face 28 can strike against a further stop face 27' of stop body 33, said stop face 27' being appropriately formed by the inside of end wall 34 and arranged in such a way that simultaneously the front end face of pump piston 6 strikes against the cylinder bottom plate 22. The end wall 34 is traversed by the piston sleeve 19 or the piston rod, so that it can contribute to the positional stabilization thereof.

In order that the pump cylinder or media reservoir 3 cannot be removed from the remaining discharging apparatus 1 again after mounting on the pump piston 6 or at least after carrying out the first or last partial stroke, a removal preventing means 40 is provided. In the represented embodiment, the latter has at least one locking shoulder 41 substantially fixed with respect to body 2 in the stroke direction and with which is associated on pump cylinder 5 a counter-shoulder 42 in such a way that the latter is engaged behind by the locking shoulder 41 in the locking position. The locking shoulder 41, which can be resiliently widened in the manner of a locking gripper can in simple manner be formed by the shoulder face of collar 31 remote from stop face 27 or facing stop face 27' and which has a spacing from the latter substantially identical to the axial extension of collar 23 of pump cylinder 5. Thus, the counter-shoulder 42 can be formed by a circular end face of collar 23 remote from the open end face and to whose external diameter is adapted the internal width of the spring arms 32 between locking shoulder 41 and stop face 27'. If collar 23 is located in this area, then it is positively fixed with respect to body 2 in the axial direction of the discharging apparatus, so that it is only possible to remove the pump cylinder 5 by destroying the discharging apparatus 1 or at least the stop body 33.

Whereas in the embodiment according to FIGS. 1 to 3 the end wall 15 forming the handle 14 is substantially planar, in the embodiment of FIGS. 4 and 5 said handle **14*a* is formed by two concavely hollowed out finger depressions according to FIG. 4 rising from the narrow ends of the end wall via an arc angle of approximately 90° to the discharge connection 16*a***, so that the discharging apparatus la is securely held in the hand.

I claim:

1. A dispenser for manually discharging flowable media, comprising:

a body provided to receive a media reservoir;

a thrust piston pump, having two pump components providing a pump piston and a pump cylinder engaging along a surface defining a piston path, said pump components being displaceable with respect to each other between an initial position and an end position of a pump stroke, said piston path defining an elongation envelope having an outside;

a pump chamber providing a dosing chamber determining a discharge volume per pump stroke, said dosing chamber being bounded by said pump cylinder and said pump piston;

a discharge opening of the apparatus in fluid connection with said dosing chamber via an outlet channel; and, at least one limiting device for reducing the discharge volume to at least one partial volume, and wherein said limiting device is located entirely on said outside of said elongation envelope defined by the piston path, said limiting device extending at most up to said outside, said limiting device having at least one stop associated with a counter-stop, said stop providing a stroke stop for limiting said pump stroke to at least one partial stroke, said stop being provided on a component movable with respect to the pump cylinder commonly with the pump piston, said counter-sop being formed by an end face of said pump cylinder.

2. A dispenser for manually discharging flowabel media comprising:

a body provided to receive a media reservoir, with a thrust piston pump having two pump components providing a pump piston and a pump cylinder engaging along a surface defining a piston path, said pump components being displaceable with respect to each other between an initial position and an end position of a pump stroke;

a pump chamber providing a dosing chamber determining a discharge volume per pump stroke, said dosing chamber being bounded by said pump cylinder and said pump piston;

a discharge opening of the apparatus in fluid connection with said dosing chamber via an outlet channel; and, at least one limiting device for reducing the discharge volume to at least one partial volume, said limiting device having at least one stop associated with a counter-stop, said stop providing a stroke stop for limiting said pump stroke to at least one partial stroke, said stop being located outside said pump cylinder, said stop being associated with an end face of said pump cylinder, and wherein said stop is provided as a counter-stop face, said stop being located in a cap-like operating handle for said thrust piston pump.

3. The dispenser according to claim 2, wherein limiting members of said limiting device are provided for interengagement and are located in a vicinity of a circumferential outside of said pump cylinder.

4. The dispenser according to claim 2, wherein means are provided for releasing said limiting device to permit to discharge of a further partial volume, said stop being constructed as a detent which can be overcome under a predetermined pump operating force.

5. The dispenser according to claim 2, wherein said limiting device has at least one stop associated with a counter-stop, said stop providing a stroke stop for limiting said pump stroke to at least one partial stroke, said pump cylinder being a one-part component including said counter-stop.

6. The dispenser according to claim 2, wherein said stop is resiliently constructed, said stop being provided on a spring arm substantially parallel to a pump axis of the pump, said stop having a ramp for said counter-stop.

7. The dispenser according to claim 2, wherein said stop extends in flange-like manner around a pump axis, said stop being formed by at least one circumferentailly subdivided inner collar, said stop providing a resiliently self-adapting centering guide for said pump cylinder.

8. The dispenser according to claim 2, wherein said stop extends in flange-like manner around an axis of the pump, said stop being formed by at least one circumferentially subdivided inner collar.

9. The dispenser according to claim 2, wherein said stop has a resiliently spreadable clip formed by at least two partial sleeve-like spring arms.

10. A dispenser for manually discharging flowable media comprising;

a body provided to receive a media reservoir;

a thrust piston pump, having two pump components providing a pump piston and a pump cylinder engaging along a surface defining a piston path, said pump components being displaceable with respect to each other between an initial position and an end position of a pump stroke, said piston path defining an elongation envelope having an outside;

a pump chamber providing a dosing chamber determining a discharge volume per pump stroke, said dosing chamber being bounded by said pump cylinder and said pump piston;

a discharge opening of the apparatus in fluid connection with said dosing chamber via an outlet channel; and at least one limiting device for reducing the discharge volume to at least one partial volume, and wherein said limiting device is located entirely on said outside of said elongation envelope defined by the piston path, said limiting device extending at most up to said outside, said limiting device having at least one stop associated with a counter-stop, said stop providing a stroke stop for limiting said pump stroke to at least one partial stroke, said top being formed by a socket-like body having an end wall and spring arms projecting from said end wall, said stop body being fixed by plug insertion into a retaining clip engaging around an outer circumference of said stop body.

11. A dispenser for manually discharging flowable media comprising:

a body provided to receive a media reservoir, with a thrust piston pump having two pump components providing a pump piston and a pump cylinder engaging along a surface defining a piston path, said pump components being displaceable with respect to each other between an initial position and an end position of a pump stroke;

a pump chamber providing a dosing chamber determining a discharge volume per pump stroke, said dosing chamber being bounded by said pump cylinder and said pump piston;

a discharge opening of the apparatus in fluid connection with said dosing chamber via an outlet channel; and, at least one limiting device for reducing the discharge volume to at least one partial volume, said limiting device having at least one stop associated with a counter-stop, said stop providing a stroke stop for limiting said pump stroke to at least one partial stroke, and wherein upstream of said stop and a stop face is provided a centering guide for a reciprocal alignment of said pump cylinder, said pump piston and said body, said centering guide being formed by at least one conical inner face of said stop body providing said stop.

12. A dispenser for manually discharging flowable media comprising:

a body provided to receive a media reservoir;

a thrust piston pump having a pump piston displaceably guided on a piston path of a pump cylinder between an initial position and an end position of a pump stroke;

a pump chamber providing a dosing chamber determining a discharge volume per pump stroke, said dosing chamber being bounded by said pump cylinder and said pump piston;

a discharge opening of the apparatus in fluid connection with said dosing chamber via an outlet channel, wherein retaining means are provided for preventing removal of the pump cylinder by preventing a return stroke from beyond a point at which the pump cylinder is located at an end of at least one of a partial stroke and said pump stoke.

13. The dispenser according to claim 12, wherein said retaining means comprises a stop additionally including a stop of a limiting device for reducing the discharge volume to at least one partial volume.

14. The dispenser according to claim 13, wherein a counter-shoulder is provided on said pump cylinder for receiving said stop in barb-like manner.

15. The dispenser according to claim 14, wherein said counter-shoulder is located on said outer circumference of said pump cylinder.

16. The ispenser according to claim 13, wherein said stop has opposite stop faces.

17. The dispenser according to claim 12, wherein said retaining means is located in a cap-like operating handle for said thrust piston pump.

18. The dispenser according to claims 1, 2, 10, 11, or 12, wherein said media reservoir is formed by a cup-shaped pump cylinder closed on a cylindrical bottom thereof and constructed as a separate vessel mountable on the pump piston after opening a closure means of said cylinder.

19. The dispenser according to claims 2 or 11, wherein said body is formed by an operating handle for said thrust piston pump, the operating handle receiving in a projecting discharge connection a piston shaft forming the pump piston located within said operating handle and said stop on an inside of an end wall carrying the discharge connection, said piston shaft tranversing said stop on an inside.

20. The dispenser according to claims 1, 2, 11 or 12, wherein said media resrvoir is formed by a cup-shpaped pump cylinder closed on a cylindrical bottom thereof and constructed as a separate vessel mountable on pump piston after opening a closure means on said vessel, said pump cylinder being a one-part component, and providng an operating handle for said thrust piston pump, said operating handle being formed by an exposed end wall of said pump cylinder.

21. The dispenser according to claims 2 or 11, wherein said body is formed by an operating handle receiving a dischrge connection a piston shaft forming the pump piston located within said operating handle on an inside of an end wall carrying the discharge connection.

22. The dispenser according to claims 1, 2, 11 or 12, wherein said pump cylinder provides an operating handle for said thrust piston pump, said operating handle being formed by an exposed end wall of said pump cylinder.

23. The dispenser according to claim 22, wherein said operating handle is protectively and spacedly surrounded by a casing having at least one access opening providing access to said operating handle.

24. A dispenser for manually discharging flowable media comprising;

a body provided to receive a media reservoir;

a thrust piston pump, having two pump components providing a pump piston and a pump cylinder engaging along a surface defining a piston path, said pump components being displaceable with respect to each other between an initial position and an end postion of a pump stroke, said pisoton path defining an elongation envelope having an outside;

a pump chamber providing a dosing chamber determining a discharge volume per pump stroke, said dosing chamber being bounded by said pump cylinder and said pump position;

a discharge opening of the apparatus in fluid connection with said dosing chamber via an outlet channel; and, at least one limiting device for reducing the discharge volume to at least one partial volue, and wherein said limiting device is located entirely on said outside of said elongation envelope defined by the piston path, said limiting device ecxtending at most up to said outside, said limiting device having at least one stop associated with a counter-stop, said stop providing a stroke stop for limiting said pump stroke to at least one partial stroke, upsteam of said stop and a stop face being provided a centering guide for a reciprocal alignment of said pump cylinder and said body.

25. A dispenser for manaully discharging flowable media comprising:

a body provided to receive a media reservoir;

a thrust piston pump, having two pump components providing a pump piston and a pump cylinder engaging along a surface defining a piston path, said pump components being displaceable with respect to each other between an initial position and an end position of a pump stroke, said piston path defining an elongation envelope having an outside;

a pump chamber providing a dosing chamber determining a discharge volume per pump stroke, said dosing chamber being bounded by said pump cylinder and said pump piston;

a discharge opening of the apparatus in fluid connection with said dosing chamber via an outlet channel; and, at least one limiting device for reducing the discharge volume to at least one partial volume, and wherein said limiting device is located entirely on said outside of said elongation envelope defined by the piston path, said limiting device extending at most up to said outside, said limiting device having at least one stop associated with a counter-stop, said stop providing a stroke stop for limiting said pump stroke, wherein said stop is located outside said pump cylinder, said stop being associated with an end face of said pump cylinder provided as a counter-stop face and being fomed by an open end of said pump cylinder.

26. A dispenser for manually discharging flowable media comprising:

a body provided to receive a media reservoir;

a thrust piston pump, having two pump components providing a pump piston and a pump cylinder engaging along a surface defiringg a piston path, said pump components being displaceable with respect to each other between an initial position and an end positon of a pump stroke, said piston path defining an elongation envelope having an outside;

a pump chamber providing a dosing chamber determining a discharge volume per pump stroke, said dosing chamber being bounded by said pump cylinder and said pump piston;

a dicharge opening of the apparatus in fluid connection with said dosing chamber via an outlet channel; and, at least one limiting device for reducing the discharge volume to at least one partial volume, and wherein said limiting device is located entirely on said outside of said elongation envelope defined by the piston path, said limiting device extending at most up to said outside, said limiting device having at least one stop associated with a counter-stop, said stop providing a stroke stop for limiting said pump stroke to at least one partial stroke, said stop being formed by a muff-like stop body having an end wall and spring arms projecting from said end wall, said stop body being fixed by plug insertion into a retaining clip engaging around the outer circumference of said stop body and located on an inside of an operating handle.

* * * * *